US007937857B2

(12) United States Patent
Staubli

(10) Patent No.: US 7,937,857 B2
(45) Date of Patent: May 10, 2011

(54) GROUND-WORKING MACHINE

(76) Inventor: Herbert Staubli, Ftan (CH)

( * ) Notice: Subject to any disclaimer, the term of this patent is extended or adjusted under 35 U.S.C. 154(b) by 0 days.

(21) Appl. No.: 12/527,275

(22) PCT Filed: Jan. 3, 2008

(86) PCT No.: PCT/CH2008/000004
§ 371 (c)(1),
(2), (4) Date: Aug. 14, 2009

(87) PCT Pub. No.: WO2008/098383
PCT Pub. Date: Aug. 21, 2008

(65) Prior Publication Data

US 2010/0083543 A1 Apr. 8, 2010

(30) Foreign Application Priority Data

Feb. 14, 2007 (CH) ..... 0238/07

(51) Int. Cl.
*E02F 5/08* (2006.01)
*E02F 3/10* (2006.01)

(52) U.S. Cl. ..... 37/96; 37/464

(58) Field of Classification Search ..... 37/348, 37/347, 452–457, 142.5, 91, 94–96, 463, 37/464; 299/36.1, 39.1–40.1, 95, 10; 404/124, 404/128
See application file for complete search history.

(56) References Cited

U.S. PATENT DOCUMENTS

| | | | | |
|---|---|---|---|---|
| 3,823,983 | A * | 7/1974 | Peterson | 301/43 |
| 4,865,400 | A * | 9/1989 | Caron et al. | 305/114 |
| 6,148,549 | A | 11/2000 | Bykov | |
| 6,418,646 | B1 | 7/2002 | Bykov | |
| 6,547,336 | B2 * | 4/2003 | Hoffmann | 299/10 |
| 6,725,579 | B2 | 4/2004 | Unzicker | |
| 7,108,452 | B2 * | 9/2006 | Caron et al. | 404/124 |
| 7,198,333 | B1 * | 4/2007 | Freeman | 301/43 |

FOREIGN PATENT DOCUMENTS

| | | |
|---|---|---|
| DE | 2 264 710 | 9/1974 |
| DE | 24 11 244 | 9/1975 |
| DE | 28 16 723 A1 | 11/1979 |
| DE | 37 37 864 A1 | 5/1989 |
| DE | 37 40 753 A1 | 6/1989 |

* cited by examiner

*Primary Examiner* — Robert E Pezzuto
(74) *Attorney, Agent, or Firm* — Morriss O'Bryant Compagni, P.C.

(57) ABSTRACT

The invention relates to a ground-working machine (11) equipped with a drive and with advancement members (21). Its advancement members (21) serve inter alia to carry a supporting structure (23) set apart from the positioning plane of the machine, on which supporting structure (23) there is arranged, in the region of a central axis (Z), a kirving tool (25) with at least one transverse kirving roller (13) for working a substrate on which the ground-working machine is standing. The kirving roller (13) is rotatable about its roller axis (V). The roller axis (V) is pivotable about a steering axis (W), which steering axis (W) is arranged in the direction of the central axis (Z) set apart from the advancement members (21).

18 Claims, 8 Drawing Sheets

Fig. 8
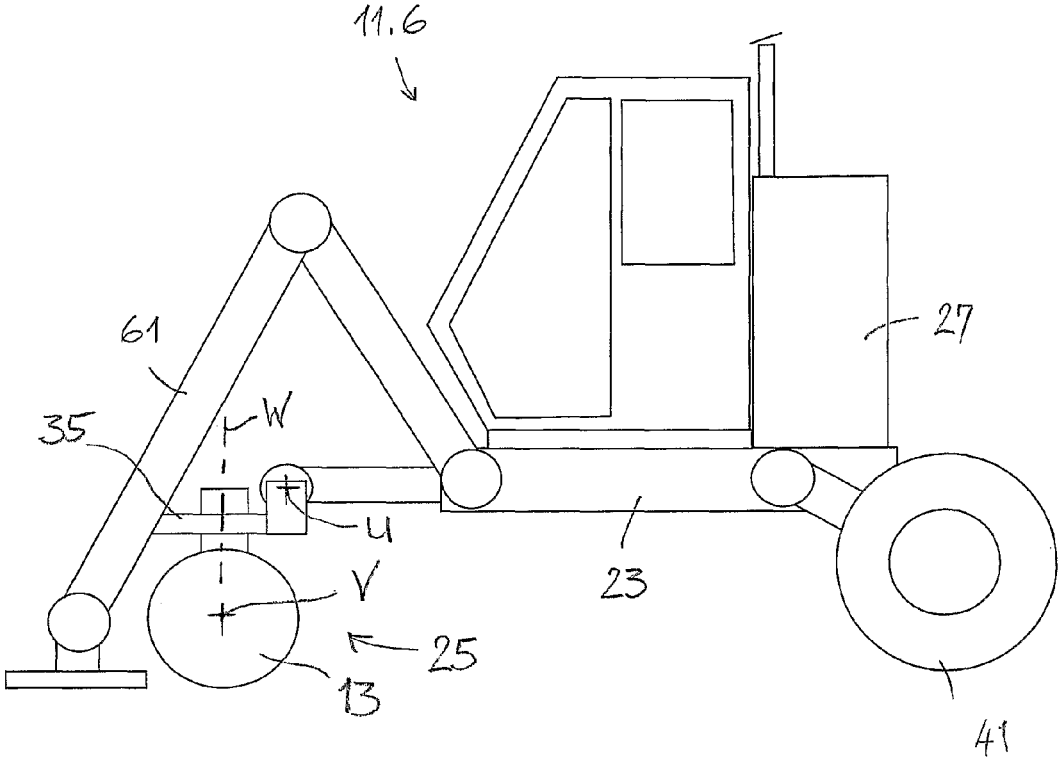
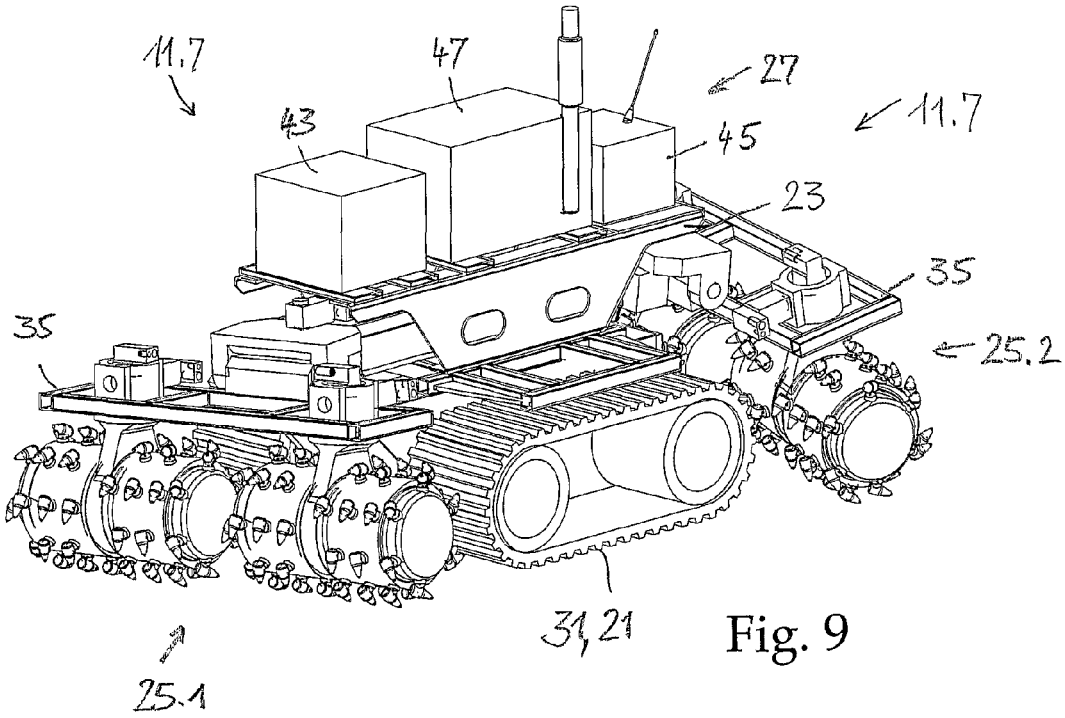
Fig. 9

GROUND-WORKING MACHINE

CROSS-REFERENCE TO RELATED APPLICATIONS

This application claims priority to PCT/CH2008/000004 filed on Jan. 3, 2008 and CH00238/07 filed on Feb. 14, 2007, the entirety of each of which is incorporated by this reference.

BACKGROUND OF THE INVENTION

1. Field of the Invention

The invention relates to a ground-working machine with a roller-like, transverse kirving tool. Machines of this type are known for levelling the roadway in road building, for the demolition of buildings and plants, the excavation of ditches and pits, the removal of root structures and rock formations, and also for the removal of rocks in tunnel construction and the removal of material in mines, for example gypsum, coal or salt mines. In the machines for roadway building, the axis of the kirving tool is integrated in a vertically adjustable, but non-pivotable manner in a vehicle provided with a crawler drive.

2. State of the Art

U.S. Pat. No. 6,725,579 discloses an excavation machine which is designed as a crawler vehicle on which there is arranged an excavation arm which is arranged at the back in the direction of travel. The excavation arm is divided into a first region close to the vehicle and a second region remote from the vehicle. The first region is vertically pivotable about a horizontal axis. The second region comprises a kirving tool which has in a known manner a chain drive and, on both sides of this chain drive, a kirving roller. The second region of the excavation arm is pivotable in relation to the first region of the excavation arm about an axis directed in the direction of the arm. This allows the transverse inclination of the worked substrate to be adapted.

In most conventional machines which are also heavy apparatuses with a crawler drive, the roller-like kirving tool is fastened to an arm, which arm is pivotable about a horizontal axis in order to define the working height of the kirving tool. The arm is often also pivotable about a vertical axis in order to extend the working region in width, i.e. transversely to the direction of travel of the machine. Machines of this type are expedient, in particular, in tunnel construction, as they offer the possibility of enlarging the tunnel profile, both in height and in width, to the planned dimensions.

The term "transverse kirving tools" refers to kirving tools having an axis of rotation extending transversely to the kirving direction. Propulsion thereof in the direction of the axis of rotation is possible merely to a limited extent, that is to say, provided that the kirving depth corresponds substantially to the spacing of the tips of the kirving chisels from the roller surface to which they are fastened. Generally speaking, transverse kirving rollers are formed by two roller-like kirving bodies which lie on a common roller axis, are equipped with kirving chisels and between which the drive and the suspension are arranged.

Kirving tools of this type can also be fastened to a dredger arm. They can be mounted there, as required in each case, in two directions lying perpendicularly to each other. The roller axis therefore lies perpendicularly to a vertical plane through the dredger arm, or else parallel to this plane.

Machines for milling off the road surface are known from the two Offenlegungsschriften DE 24 11 244 and DE 2 264 710. The machines possess a running gear with a drive motor and a milling roller driven via a cardan shaft. During operation, the milling roller is wider than the chassis. For the pure travelling mode of the machine, the milling roller is detachable from the drive and pivotable, together with a mount, through 90 degrees into a rest position in which the entire milling roller is located within the outer longitudinal delimiting lines of the machine. This prevents the excess width, which has a beneficial effect on the degree of utilisation, of the milling roller from becoming disruptively noticeable during transportation.

The known machines are not suitable for building paths in areas which are difficult to access. They are too large and insufficiently flexible. Paths, for example footpaths, follow narrow curves, which these known devices have difficulty following, and have a width of 1 m to 1.5 m, so that it is not possible to travel thereon using machines of this type which require a roadway of at least approximately 2 meters.

It would therefore be an advantage to provide a ground-working machine which can be used to build even on footpaths and the like.

SUMMARY OF THE INVENTION

According to the invention, a ground-working machine is equipped with a drive and advancement members. The advancement members are configured to advance the ground-working machine along a central axis of the ground-working machine, define at least partially a positioning plane of the ground-working machine and carry a supporting structure apart from the positioning plane. A kirving tool is arranged on the supporting structure in the region of the central axis. The kirving tool has at least one transverse kirving roller for working a substrate on which the ground-working machine is positioned. The kirving roller has kirving chisels on a circumference of the kirving roller oriented toward the direction of rotation of the kirving roller and, for kirving, can be rotated by the drive in the direction of rotation about its roller axis, the roller axis being pivotable about a steering axis. The steering axis is arranged in a direction of extension of the central axis set apart from the advancement members. The kirving roller is drivable in any rotational position with respect to the steering axis.

In a known manner, the ground-working machine according to the invention is equipped with a drive and with advancement members. These advancement members serve to advance the ground-working machine along a central axis of the ground-working machine, or to pivot the position of this central axis with respect to the points of the compass, in order to advance the machine in the desired direction. They define at least partially a positioning plane of the ground-working machine and carry a supporting structure set apart from this positioning plane. A kirving tool having at least one transverse kirving roller is arranged on the supporting structure in the region of the central axis. The kirving tool can and is to be used for working a substrate on which the ground-working machine is standing. The kirving roller has on its roller circumference kirving chisels oriented toward the direction of rotation of the kirving roller and, for kirving, can be rotated by a drive in the direction of rotation about its roller axis.

According to the invention, in a machine of this type, the roller axis of the driven kirving roller is embodied so as to be able to pivot about a steering axis. The kirving roller can therefore be driven in any rotational position of the roller axis with respect to the steering axis. The term "steering axis" refers to an axis allowing the roller axis to be deflected, for example, from a horizontal position, directed perpendicularly to the central axis, into a position directed at an angle to the central axis. In order for the kirving roller to lie, even in the deflected state, in the region of the substrate to be worked and to be able to work said substrate, the steering axis is arranged, in the direction of the central axis, set apart from the advancement members. The greater the spacing from the advancement members is, the larger the possible pivoting angle of the kirving roller within which the kirving roller does not leave a lane of the machine. If the spacing between the kirving members and steering axis corresponds to at least half the width of the kirving roller, then the kirving roller can be deflected by up to 90 degrees to the left and to the right without having to leave the lane. At a spacing between the steering axis and the roller axis of half the width of a lane, the working region of the kirving roller lies at all times within the lane width. The working region, defined by the spacings between the steering axis and advancement members, on the one hand, and between the steering axis and roller axis, on the other hand, is intended advantageously to allow the driven roller to rotate through 360 degrees within the lane. This allows the roller to work the substrate in the region of the lane in any desired direction.

Expediently, the kirving tool is arranged on the supporting structure in such a way that the kirving roller can be arranged above the positioning plane such that its roller circumference touches the positioning plane. In this position, the steering axis of the kirving roller is to deviate by 0 to at most 45 degrees from a vertical line relative to the positioning plane. If the steering axis is a vertical line relative to the positioning plane, then the kirving roller can be rotated about the steering axis and the region of contact between the circumference of the kirving roller and the substrate lies in the positioning plane in any rotational position. An inclined steering axis lies advantageously on a vertical plane parallel to the central axis of the machine. In the case of an inclined steering axis, the roller axis also becomes inclined, on deflection thereof, with respect to the positioning plane. It is therefore very easy to kirve an arched transverse profile of a path using a kirving roller having an inclined steering axis.

The inclination of the steering axis can be embodied so as to descend from the back forward, as in a bicycle, or conversely so as to rise from the back forward. A preferred deviation of the steering axis from the vertical line relative to the positioning plane lies between 0 and 30 degrees. Angles in the range of up to 15 degrees are particularly preferred.

If the steering axis intersects the roller axis, that produces a circular working region of the kirving roller having a radius equal to half the width of the kirving roller. If, however, the steering axis lies between the roller axis and the advancement members, or else opposite the advancement members and set apart from the roller axis, then this produces a larger, but annular working region. An advantageous spacing of the steering axis from the roller axis lies at at most ⅗ of the width of the ground-working machine. Thus, the working range of the kirving roller, which is deflected through 90 degrees, reaches only slightly beyond the lane of the machine.

In a simple embodiment, the machine is equipped with a single kirving roller. However, further embodiments can have two or more kirving rollers. The kirving rollers can be combined to form one, two or more kirving tools. A one particular embodiment of these embodiments is distinguished in that the kirving tool comprises two kirving rollers. The roller axes of these two kirving tools are adjustable relative to each other each about their own steering axis, that is to say, about two steering axes set apart from each other. This allows the two kirving tools to act on the substrate in different directions. As a result, the forces occurring as a result of the kirving in the machine could be directed partially counter to one another. Furthermore, kirved-off material can for example be displaced in a desired direction using deflected and rotating kirving rollers. It is thus possible to configure a roadway.

In advantageous exemplary embodiments of the invention, the kirving tool comprises a frame part which is pivotable in relation to the supporting structure. The steering axis can then be formed between the frame part and the supporting structure. However, there can also be formed the steering axis between the kirving roller and the frame part and, in addition, a pivot axis between the frame part and supporting structure. The orientation of a pivot axis of this type does not in any way have to be parallel to the steering axis.

On the contrary, the frame part can be pivotable in relation to the supporting structure about an axis parallel to the central axis in order to define a transverse inclination of the kirved substrate via an inclination of the kirving line (or roller axis) relative to the positioning plane.

Furthermore, the frame part can be pivotable in relation to the supporting structure about a substantially horizontal axis lying perpendicularly to the central axis. This substantially horizontal axis can be pivotable about the axis parallel to the central axis. Conversely, the axis parallel to the central axis can also be pivotable about the aforementioned substantially horizontal axis.

Furthermore, the frame part can be pivotable in relation to the supporting structure about a substantially vertical axis lying perpendicularly to the central axis. The steering axis then does not coincide with this vertical axis, but is formed between the frame part and the or each kirving roller.

Furthermore, it can also be jointly formed between the frame part and the kirving rollers. This also allows the kirving tool to be arranged next to the lane of the machine, or to be arranged so as to protrude beyond the lane, and it facilitates curved travel.

Examples of advancement members include crawlers, progressing units and wheels. Combinations of wheels and progressing units, combinations of kirving tools and progressing units, or other combinations are also conceivable. In principle, kirving tools can also be provided as advancement members. This is possible provided that the machine is geared to the kirving rollers, or else possesses no other advancement members at all. In this case, the kirving roller is used differently, that is to say, partly as an advancement member, partly as a kirving tool, partly as both simultaneously.

In any embodiment of the machine according to the invention, the kirving tools can be used as drive members and be utilised for advancement.

The advancement members, i.e. progressing units, wheels, crawlers or kirving tools, can be embodied so as to be vertically adjustable in relation to the supporting structure in order to compensate for uneven sections of ground and to more easily attain a desired kirving result.

For coordinated activation of the individual kirving tools and advancement members, it is almost essential to provide a control unit which carries out this coordination in a computer-supported manner. The commands which the machine has to carry out are then much more set targets which the control unit converts into the targeted activation of the individual drive members, advancement members, graders and kirving tools and monitors by means of sensors. Sensors of this type detect, for example, the orientation of the machine with respect to the points of the compass, the horizontal (transverse inclination, gradient of the substrate or the machine), spacing of the kirving tools from surrounding elements, position of the kirving tools, speed, etc.

In a particular variant design of ground-working machines of this type—or similar machines differing from the above-described invention—the machine is equipped with a receiver for the Global Positioning System (GPS) and a navigation system. The former can ascertain the position of the machine in relation to absolute coordinates, and the latter can establish the route to be passed through in order to arrive at a specific location. This is used for the scheduled activation of the control unit, so that the ground-working machine can follow a given, three-dimensionally fixed path and produces the path in the process. A ground-working machine of this type has in common with the machines described hereinbefore the fact that it is equipped with a drive and with advancement members, the advancement members serve to advance the ground-working machine along a central axis of the ground-working machine, define at least partially a positioning plane of the ground-working machine and carry a supporting structure set apart from this positioning plane. This supporting structure is equipped in the region of the central axis with a kirving tool comprising at least one transverse kirving roller for working a substrate on which the ground-working machine is standing. This kirving roller has on its roller circumference kirving chisels oriented toward the direction of rotation of the kirving roller and, for kirving, can be rotated by a drive in the direction of rotation about its roller axis. According to this second invention, the ground-working machine is equipped with an electronic controller and a navigation system (including a GPS receiver or the like) for scheduled activation of the control unit, so that the ground-working machine can follow a given, three-dimensionally fixed path, in that the drive and the at least one kirving tool are activated in such a way that the ground-working machine automatically kirves an electronically input ground modulation.

A third idea consists in the fact that, in the machine according to the present invention, the kirving tool defines, together with the advancement members, the positioning plane. That is to say, that the kirving tool cannot be raised, but has to stand on the substrate. In a simple machine of this type, the advancement members define merely one line, the kirving tool standing on the substrate set apart from this line.

Still another approach consists in the fact that the machine according to the preamble of Claim 1 is equipped with two kirving rollers, the roller axes of which can be oriented independently of each other.

BRIEF DESCRIPTION OF THE DRAWING

The invention will be described hereinafter in greater detail with reference to schematic drawings, in which:

FIG. 8 is a side view of a sixth exemplary embodiment with wheels and progressing units; and FIG. 9 is a perspective view of a seventh exemplary embodiment with crawlers and, at the back and front, a kirving tool.

DETAILED DESCRIPTION OF THE ILLUSTRATED EMBODIMENT

Figure 3:
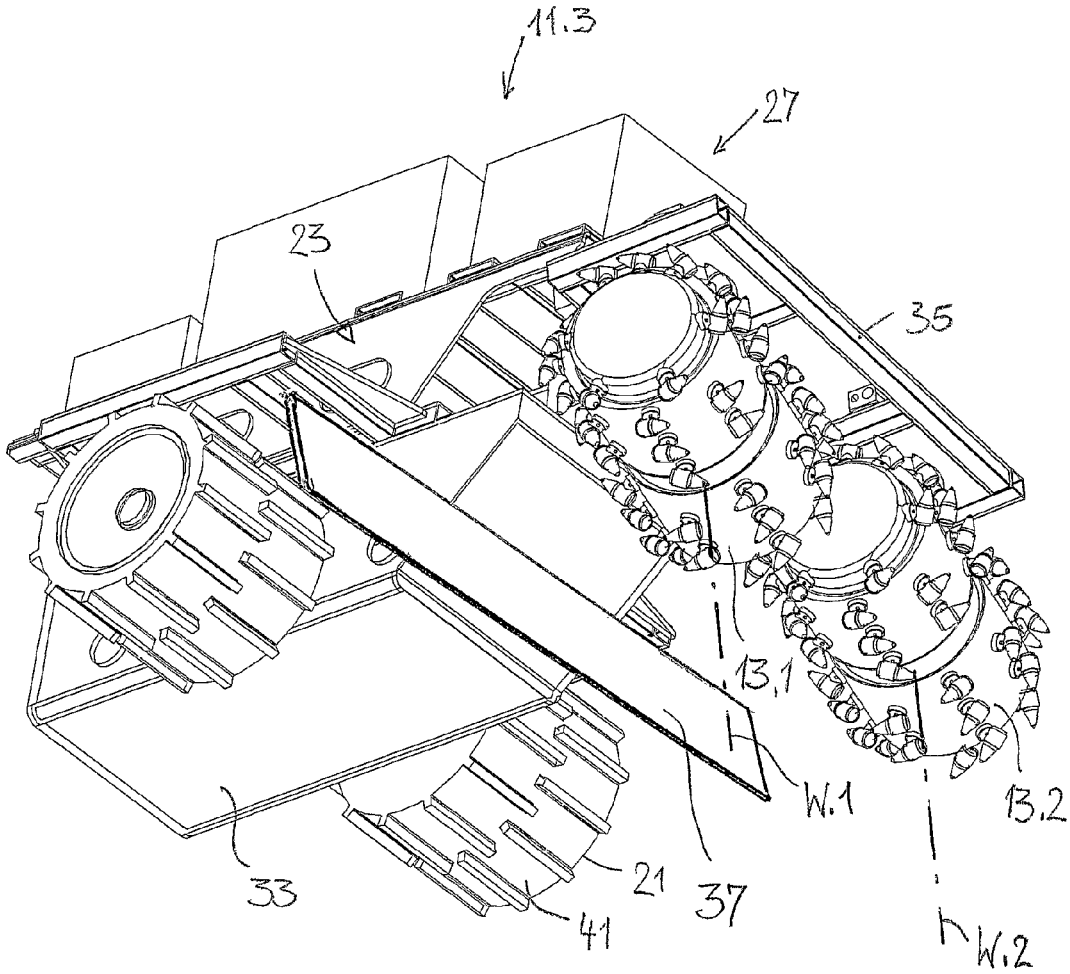
FIG. 3 is a perspective view of a third exemplary embodiment with two independently actuatable kirving rollers and two wheels.
Figure 5:
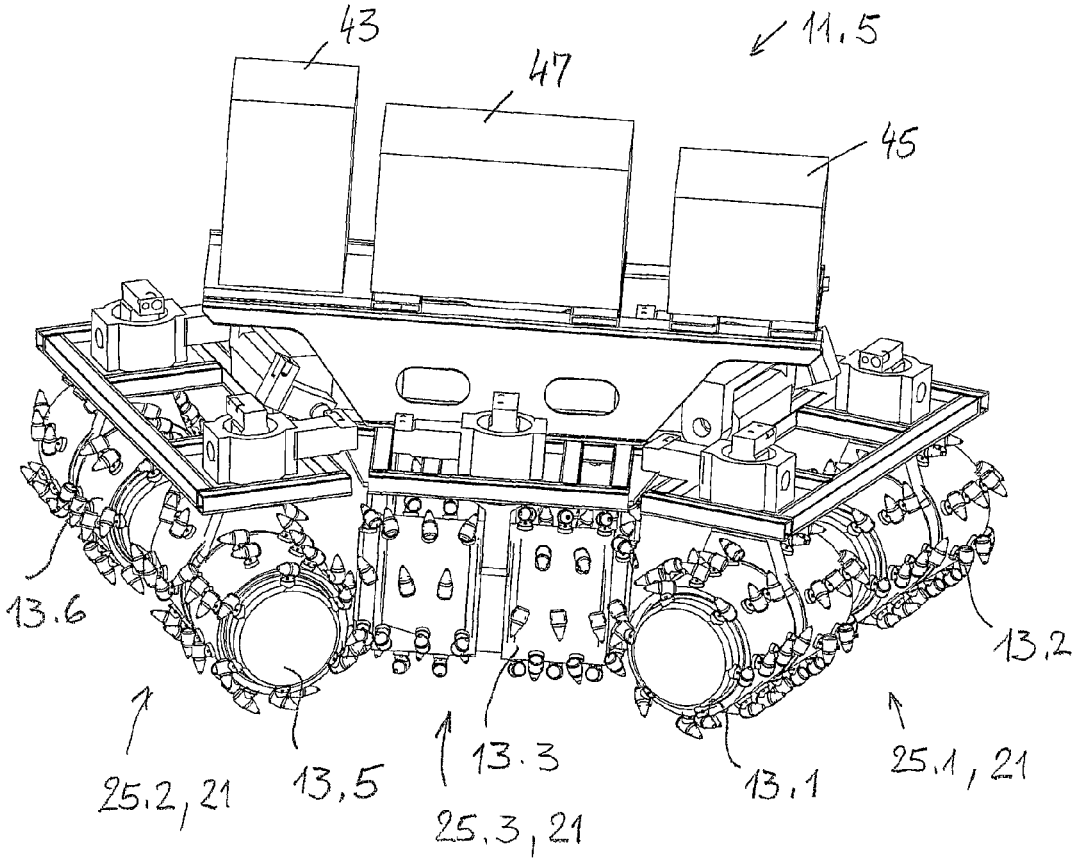
FIG. 5 is a perspective view of a fifth exemplary embodiment with six independently adjustable and drivable kirving rollers.
Figure 6:
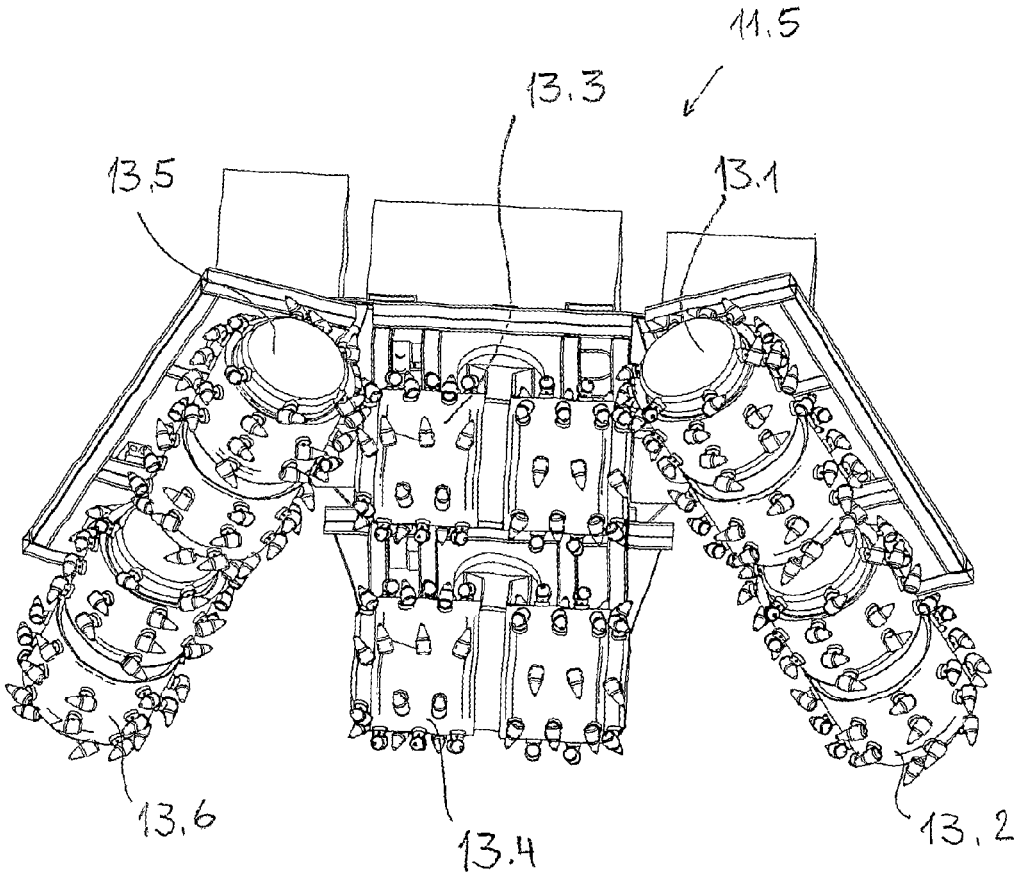
FIG. 6 is a perspective view from below of the fifth exemplary embodiment.

In the exemplary embodiments according to FIGS. 3, 5 and 6, the kirving rollers 13 are shown incorrectly in so far as all the kirving chisels 15 are intended to be oriented toward the same direction of rotation. However, in these figures, the kirving chisels 15 are generally designed, on one side of the roller suspension 17, for rotation in one direction and, on the other side of the roller suspension 17, incorrectly for rotation in the opposite direction.

This illustrated arrangement of the kirving chisels 15 can be selected, and the kirving rollers can then be driven, to the left and right of the roller suspension 17, in opposite directions. However, provision is generally made not for this, but rather for a variation of the kirving roller 13 that is normally not selected.

Piece-by-piece, the ground-working machines 11 illustrated in FIGS. 1 to 6 have a similar construction:

They stand with advancement members 21 on a substrate (not shown). They have a carrier structure 23 (cf. FIG. 7) on which kirving tools 25 are arranged and which is held by the advancement members 21 set apart from the substrate. The kirving tools 25 are equipped with at least one transverse kirving roller 13. The carrier structure 23 carries the necessary assemblies 43, control units 45 and motors 47 as the drive 27 for operating the machine 11.

Figure 7:
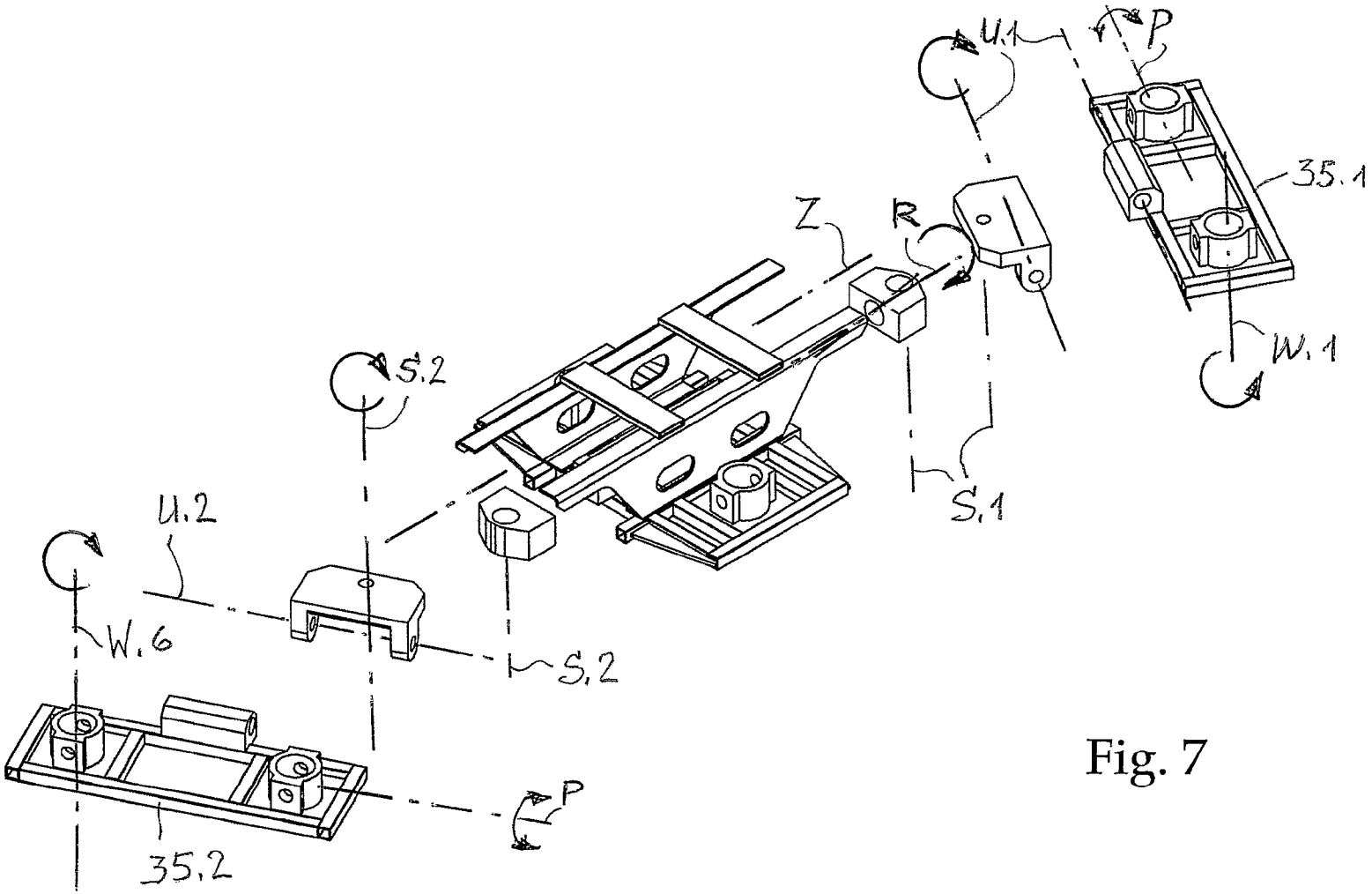
FIG. 7 is a perspective view of the supporting structure and the frame parts of the kirving tools of the fifth exemplary embodiment with an overview over the various possible axes.

The kirving rollers 13 are embodied, to the left and right of a roller suspension 17, as two roller bodies which are rotatable about a common roller axis V (FIG. 7). The roller suspension 17 is rotatable about a steering axis W (FIG. 7). As a result, the kirving roller 13 can be oriented in any desired manner with respect to its direction of action, or its roller axis V lying perpendicularly to the direction of action can be oriented in any desired manner.

It is possible to provide a motor 47 which directly drives the advancement members via a gear mechanism and to which a power assembly or a hydraulic assembly 43 is also connected. The motor can also drive merely the assembly 43, and all the drive members and mechanical movable elements are subsequently supplied with energy via the hydraulics or the power. The power thus produced or the hydraulic pressure thus attained can then, in any case, be used to drive the kirving tool 25 and the pivoting members for the kirving tool. The drive wheels, crawlers or progressing units can also be driven electrically or hydraulically.

Corresponding parts are denoted in the figures by the same reference numerals, even if they are embodied differently.

Figure 1:
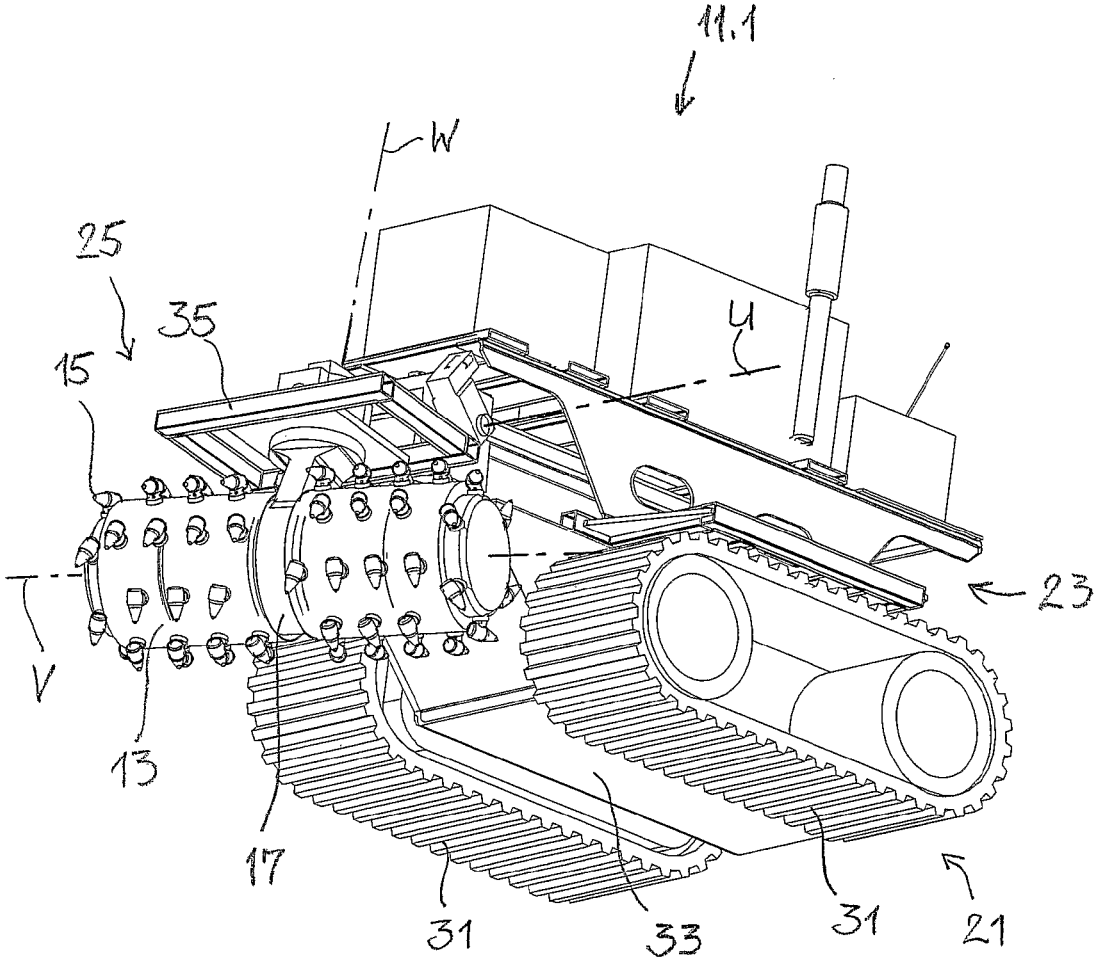
FIG. 1 is a perspective view of a first exemplary embodiment of the invention with a single kirving roller and a crawler drive.

In the exemplary embodiment of a ground-working machine 11.1 according to FIG. 1, two crawlers 31 are provided as advancement members 21. The crawlers 31 define with their underside a positioning plane. They are driven by a motor (not shown). The motor 47 and/or the drive assembly 43 and, if appropriate, a gear mechanism and also a fuel tank can be accommodated inside a drive box 33.

A frame part 35 is articulated to the supporting structure 23. The frame part 35 is part of the kirving tool 25. In the frame part 35, the roller suspension 17 is mounted so as to be able to rotate about a steering axis W. The roller axis V is rotatable through 360 degrees about the steering axis W. In practice, this angle of rotation can also be restricted. The kirving tool 25 as a whole can be pivoted about the transverse axis U in order to be raised or lowered. In this case, the steering axis W is also pivoted.

Figure 2:
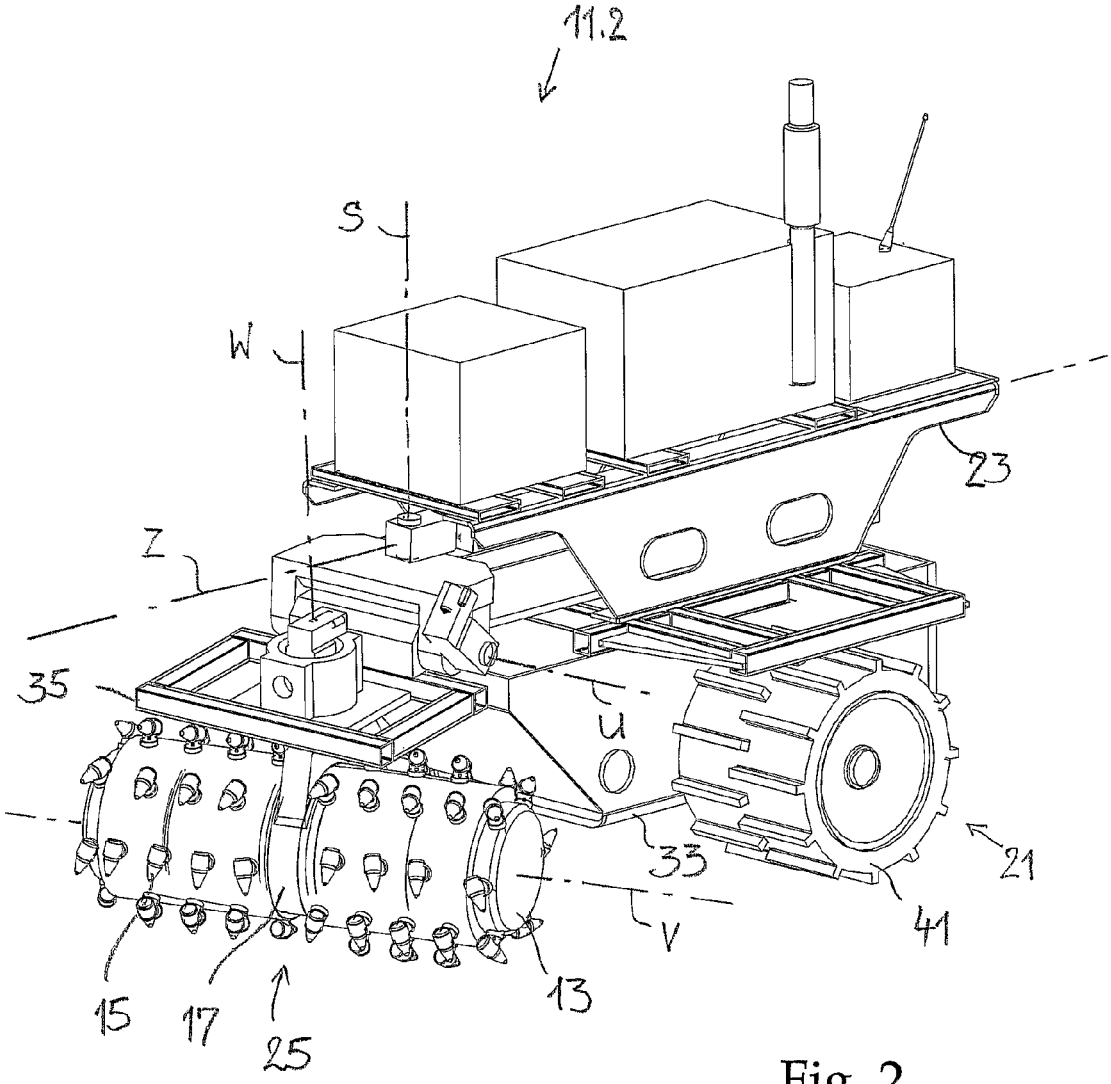
FIG. 2 is a perspective view of a second exemplary embodiment with a single kirving roller and two wheels.

In the second exemplary embodiment illustrated in FIG. 2 of a ground-working machine 11.2, the suspension of the kirving tool is drawn from a different perspective. It is therefore possible to see further features which are also provided in the first exemplary embodiment but were not described. The suspension of the kirving tool 25 is pivotable about a vertical axis S. The illustrated order of the axes S and U could also be swapped over.

The exemplary embodiment according to FIG. 2 differs from the first exemplary embodiment in terms of the advancement members 21. In this case, these are formed by two wheels 41. These wheels 41 define the positioning plane merely partially. The machine 11.2 has to utilise the kirving tool 25 as a further advancement member 21 and leave the kirving tool in contact with the ground at all times. Alternatively, a grader may be provided, such as is illustrated hereinafter.

The pivotability of the kirving tool 25 about the transverse axis U therefore serves, in this exemplary embodiment, not to raise the kirving tool, but to pivot the steering axis W. Deviation of the steering axis W from a vertical line relative to the positioning plane results in the roller axis V being inclined relative to the positioning plane during pivoting about the steering axis W. It is therefore possible to kirve paths having arched or channel-shaped transverse profiles.

The individual kirving roller 13 of the two above-described exemplary embodiments is not as wide as the lane. The total width of the lane, which is defined by the spacing and the width of the crawlers 31 or wheels 41, can nevertheless be worked, as the kirving tool can be pivoted about the axis S. This vertical axis S is set apart from the roller axis V, so that during pivoting about this axis S the entire kirving tool 25 or the steering axis W is displaced toward the side. Nevertheless, corresponding rotating of the kirving roller 13 about the steering axis W allows the kirving direction to be directed parallel to the central axis Z of the machine.

FIG. 3 illustrates a third exemplary embodiment 11.3 of the invention. In this exemplary embodiment, the drive with the motor and drive wheels is identical to the second exemplary embodiment 11.2. The same freedoms with respect to the movability of the kirving tool 25 are also provided. However, in contrast to the second exemplary embodiment 11.2, two kirving rollers 13 are arranged on the frame part 35. Each of these kirving rollers 13.1, 13.2 is pivotable about its own steering axis W.1, W.2.

It is necessary to imagine that the kirving rollers 13 pull the machine. In the position according to FIG. 3, the kirving rollers therefore pull the machine around a curve while they are working the ground. The drive wheels 41 must therefore be used above all for braking. They run over the material churned up by the kirving roller.

In the third exemplary embodiment 11.3, a grader 37 is furthermore arranged between the kirving tool 25 and the advancement members 21. Owing to this grader 37, the path surface which is produced can be made as flat as possible and the advancement members 21 offer the maximum possible resistance on the kirved ground. In addition, the grader 37 can itself be utilised to increase the resistance to forward pulling by the kirving rollers 13. The grader 37 and advancement members 21 together define the positioning plane of the machine 11.3, so that the kirving tool 25 can be raised from the ground.

Graders 37 of this type can also be provided in the other exemplary embodiments. They can expediently be adjusted by a motor vertically, in the transverse inclination and at an angle with respect to the central axis Z.

Figure 4:
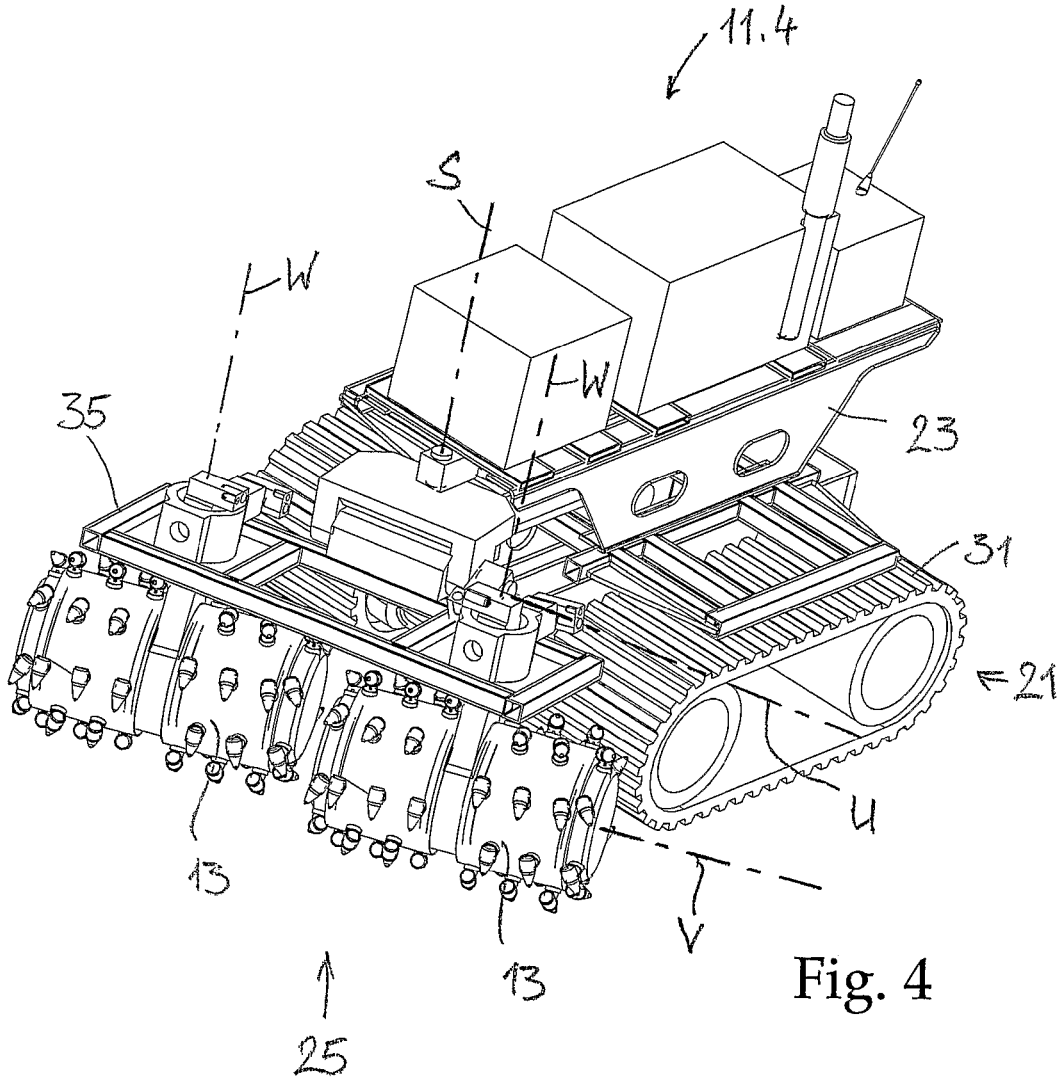
FIG. 4 is a perspective view of a fourth exemplary embodiment with two kirving rollers and a crawler drive.

The fourth exemplary embodiment 11.4 illustrated in FIG. 4 possesses, like the exemplary embodiment 11.3, two kirving rollers 13 on a frame part 35. These kirving rollers 13 are deflectable about the respective steering axis W, so that they can be oriented and used so as to work counter to each other or with each other, forwards or backwards, toward the side or toward the centre. The crawlers 31 of the exemplary embodiment 11.4 form the positioning plane on which the machine is standing and therefore allow the kirving tool 25 to be raised via this positioning plane using corresponding hydraulic cylinders (not shown).

In the fifth exemplary embodiment 11.5 illustrated in FIGS. 5 and 6, neither crawlers nor wheels are provided. The machine is equipped with six kirving rollers 13.1 to 13.6 which can serve both for kirving and for advancing the machine. In the transverse position (kirving rollers 13.3, 13.4), they can serve to displace kirved material. In this exemplary embodiment, two kirving rollers 13.3 and 13.4 are arranged on the supporting structure 23. At the front and back, kirving tools 25.1, 25.2, each having two kirving rollers 13.1, 13.2, 13.5, 13.6, are arranged on the supporting structure. The kirving tools can each be pivoted with respect to the supporting structure about a vertical axis S.1, S.2. The kirving tools can also be pivoted about a respective horizontal axis U.1, U.2. At least one of the kirving tools 25.1 (the front one) can also be rotated about an axis R parallel to the central axis Z. Each kirving roller 13 can be pivoted about a steering axis W.1 to W.6.

FIG. 7 is an overview of these axes, which are formed between the supporting structure and the frame parts of the kirving tools, and also of the steering axes which are formed between the frame parts and the kirving rollers. As costs are an important factor in the production of a machine of this type, it may be the case that not all the axes are realised. In a simplified embodiment, the frame part is accordingly securely connected to the supporting frame, or is omitted, and the kirving roller is rotatable about a steering axis. An apparatus of this type is also easier to handle than those having a plurality of kirving tools.

The more kirving tools and kirving rollers a ground-working machine of this type possesses, the harder the machine is to handle and the more the electronic, computer-supported activation of the individual tools (kirving tools 25, graders 37) and advancement members 21 (kirving rollers 13, crawlers 31, progressing units 61, wheels 41) is urgently required.

FIG. 8 illustrates a sixth exemplary embodiment in which progressing units 61 are present. The progressing units 61 can be used to support the machine. As a result, the pressure with which the kirving tool is placed onto the substrate can be adapted. The progressing units are particularly suitable for supporting the machine on an unworked substrate. The machine accordingly operates with the kirving tool at the front and the wheels are towed behind, or urge the machine forward.

A ground-working machine according to the invention can also be equipped merely with progressing units. The steering axis W is, in this apparatus, arranged set apart from the progressing unit in so far as both the point at which the progressing unit rests on the substrate and the point at which the progressing unit is articulated to the supporting structure are set apart, in the direction of the central axis Z, from the steering axis W. This allows the roller axis V to be rotatable about the steering axis W and the kirving tool to be able to work a width corresponding to the machine lane width. The advancement members require in width no more space than the kirving tool can work. Rotating the kirving tool requires space corresponding substantially to the lane width.

A cabin is also illustrated by way of example in this exemplary embodiment. In a similar manner, the other exemplary embodiments can also be equipped with a driver's seat and if appropriate with a cabin. However, the ground-working machines can also be designed as remote-controlled machines. They can even be designed as machines which automatically search for the path and clear the path. For this purpose, a machine of this type is equipped with a GPS and with programmable, intelligent electronics.

The seventh exemplary embodiment according to FIG. 9 has at the back and front kirving tools 25.1, 25.2 each having two kirving rollers 13. The pivotability of the kirving tools about an axis R parallel to the central axis Z may be seen from the illustration. Owing to the rotatability of the individual kirving rollers 13 about the steering axes W, the kirving tools 25.1 and 25.2 can be rotated in such a way that they rotate in a common direction and thus the machine is advanced. However, they can also be set and driven in such a way that they rotate directed counter to each other. In this case, the forces directed in and counter to the direction of advancement substantially cancel one another out, so that the machine continues to stand substantially on site even during kirving without an additional drive.

The invention claimed is:

1. A ground-working machine, comprising:

a drive;

advancement members, the advancement members being configured to advance a ground-working machine along a central axis of the ground-working machine, the contact points of the advancement members with the ground at least partially defining a positioning plane of the ground-working machine and the advancement members carrying a supporting structure apart from the positioning plane; and a kirving tool arranged on the supporting structure in the region of the central axis, the kirving tool having at least one kirving roller positionable in the transverse position for working a substrate on which the ground-working machine is positioned, the at least one kirving roller having kirving chisels on a circumference of the at least one kirving roller oriented toward the direction of rotation of the at least one kirving roller and, for kirving, can be rotated by the drive in the direction of rotation about a roller axis, the roller axis being pivotable about a steering axis, the steering axis being set apart from the advancement members in a direction of extension of the central axis by a distance which corresponds to at least one-half the width of the kirving roller, and the kirving roller being drivable in any rotational position with respect to the steering axis, wherein the steering axis intersects the roller axis or is situated at a distance from the roller axis which corresponds to a maximum of ⅗ of the width of the ground-working machine.

2. The machine according to claim 1, wherein the kirving tool is arranged on the supporting structure in such a way that the at least one kirving roller can be arranged above the positioning plane such that the roller circumference touches the positioning plane, and wherein the steering axis deviates, by between 0 to 45 degrees from a vertical line relative to the positioning plane.

3. The machine according to claim 2, wherein the deviation of the steering axis from the vertical line relative to the positioning plane is at most 30 degrees.

4. The machine according to claim 1, wherein the kirving tool comprises at least two kirving rollers, the roller axes of which are adjustable relative to one another each about a respective independent steering axis.

5. The machine according to claim 1, wherein the kirving tool comprises a frame part pivotable in relation to the supporting structure.

6. The machine according to claim 5, wherein the frame part is pivotable in relation to the supporting structure about an axis parallel to the central axis.

7. The machine according to claim 5, wherein the frame part is pivotable in relation to the supporting structure about a substantially horizontal axis lying perpendicularly to the central axis.

8. The machine according to claim 5, wherein the frame part is pivotable in relation to the supporting structure about a substantially vertical axis) lying perpendicularly to the central axis, and wherein the steering axis is formed between the frame part and each kirving roller or between the frame part and the kirving rollers.

9. The machine according to claim 1, wherein the advancement members comprise crawlers.

10. The machine according to claim 1, wherein the advancement members comprise progressing units.

11. The machine according to claim 1, wherein the advancement members comprise wheels.

12. The machine according to claim 1, wherein the advancement members comprise kirving tools.

13. The machine according to claim 1, wherein the advancement members are configured to be height-adjustable in relation to the supporting structure.

14. The machine according to claim 1, further comprising a grader positioned between the kirving tool and the advancement members.

15. The machine according to claim 1, further comprising a control unit for the computer-supported, coordinated activation of the individual kirving tools and advancement members, and further having a navigation system for scheduled activation of the control unit, so that the ground-working machine can follow a given, three-dimensionally fixed path.

16. A ground-working machine, comprising:

a drive;

advancement members for advancing the ground-working machine along a central axis of the ground-working machine, the contact points of said advancement members with the ground defining a positioning plane and the advancement members carrying a supporting structure; and a kirving tool mounted to the supporting structure for working a substrate on which the ground-working machine is positioned, having at least one kirving roller with kirving chisels, the kirving roller being rotatable by the drive about a roller axis, the roller axis being displaceable relative to the supporting structure by pivoting it about a steering axis, the steering axis being disposed at a distance in a direction of extension of the central axis from the advancement members, the distance in the direction of extension of the central axis corresponding to at least one-half the width of the kirving roller, and the kirving roller being drivable in any rotational position with respect to the steering axis, wherein the steering axis intersects the roller axis or is situated at a distance from the roller axis which corresponds to at most ⅗ of the width of the ground-working machine.

17. A ground-working machine, comprising a drive;

advancement members for advancing the ground-working machine along a central axis of the ground-working machine, the contact points of said advancement members with the ground defining a positioning plane and the advancement members carrying a supporting structure; and a kirving tool mounted to the supporting structure for working a substrate on which the ground-working machine is positioned, having at least one kirving roller with kirving chisels, the kirving roller being rotatable by the drive about a roller axis, the roller axis being displaceable relative to the supporting structure by pivoting it about a steering axis, the steering axis being disposed at a distance in front of or behind the advancement members, the distance from the advancement members corresponding to at least one-half the width of the kirving roller, and the kirving roller being drivable in any rotational position with respect to the steering axis, wherein the steering axis intersects the roller axis or is situated at a distance from the roller axis which corresponds to at most ⅗ of the width of the ground-working machine.

18. The ground-working machine of claim 17, wherein the advancement members are not configured for kirving and the kirving tool is not configured for advancing the ground-working machine along the central axis.

* * * * *